US006096192A

United States Patent [19]

Myers et al.

[11] Patent Number: 6,096,192

[45] Date of Patent: Aug. 1, 2000

[54] PRODUCING PIPELINABLE BITUMEN

[75] Inventors: Ronald Damian Myers; John Brenton MacLeod; Mainak Ghosh; Tapan Chakrabarty, all of Calgary, Canada

[73] Assignee: Exxon Research and Engineering Co., Florham Park, N.J.

[21] Appl. No.: 09/115,078

[22] Filed: Jul. 14, 1998

[51] Int. Cl.[7] ..... C10G 47/04; C10G 47/02; C10G 47/12; C10G 57/00

[52] U.S. Cl. ..... 208/108; 208/110; 208/111; 208/112; 208/95; 208/109; 208/370

[58] Field of Search ..... 208/108, 109, 208/110, 111, 112, 95, 370

[56] References Cited

U.S. PATENT DOCUMENTS

| | | | |
|---|---|---|---|
| 3,527,692 | 9/1970 | Titus | 208/11 |
| 4,485,004 | 11/1984 | Fisher et al. | 208/112 |
| 4,637,871 | 1/1987 | Bearden et al. | 208/112 |
| 4,933,067 | 6/1990 | Rankel | 208/45 |
| 5,236,577 | 8/1993 | Tipman et al. | 208/390 |
| 5,620,591 | 4/1997 | Poole et al. | 208/112 |
| 5,622,616 | 4/1997 | Porter et al. | 208/108 |

*Primary Examiner*—Walter D. Griffin
*Assistant Examiner*—Tam M. Nguyen

[57] ABSTRACT

A bitumen is rendered pipelineable by partially hydroconverting the bitumen and then adding sufficient diluent to the partially hydroconverted bitumen to provide a mixture having an API gravity at 15° C. of at least 19° and a viscosity at 40° C. in the range of about 35 to about 60 cP.

8 Claims, No Drawings

PRODUCING PIPELINABLE BITUMEN

FIELD OF THE INVENTION

This invention is concerned with transporting heavy hydrocarbons through a pipeline. More particularly, the present invention relates to improvements in modifying the density and viscosity of bitumen to render it suitable for transporting it through a pipeline.

BACKGROUND OF THE INVENTION

With the decrease in the reserves of conventional crude oils, there is increasing use in petroleum refineries of heavy hydrocarbons such as those extracted from oil sands. These heavy hydrocarbons typically are geographically located in regions remote from refineries that can process them. Consequently, the hydrocarbons need to be transported to a refinery, most usually through a pipeline.

Presently the most convenient method for pipelining heavy hydrocarbons is by mixing the hydrocarbon with a diluent such as natural gas condensate to lower the viscosity and density of the hydrocarbon to render it suitable for pipelining. Experience has shown, however, that in order to meet the pipeline viscosity specifications, more diluent is used than is necessary to meet the density specifications. Moreover, there is growing concern that the supply of natural gas condensate may not keep pace with the continuing growth in use of such heavy hydrocarbons.

An alternate approach to modifying the viscosity and density of heavy hydrocarbons to a range suitable for pipelining involves subjecting the hydrocarbon to "partial upgrading" by hydroconversion, especially slurry hydroprocessing. By "partial upgrading" is meant to subject the hydrocarbon to hydroprocessing under conditions and for a time sufficient to reduce the viscosity and density to pipeline specifications. Partial upgrading, however, reduces the bitumen viscosity to a greater extent than the API gravity so that at the target density the viscosity of the product is significantly lower than that which is required. Additionally, depending upon the level of conversion, among other factors, phase separation of asphaltenes may occur.

Thus, there remains a need for modifying the viscosity and density of heavy hydrocarbons which does not result in asphaltene phase separation.

Additionally, there remains a need for an improved method for rendering heavy hydrocarbons pipelineable while using reduced amounts of diluent.

SUMMARY OF THE INVENTION

Accordingly, in one embodiment of this invention, there is provided an improvement in modifying a heavy hydrocarbon suitable for pipelining comprising:

Subjecting the hydrocarbon to hydroconversion under conditions and for a time sufficient to provide a modified hydrocarbon having a viscosity of in the range of about 60 to 250 cP at 40° C. and Adding a diluent to the modified hydrocarbon in an amount sufficient to provide a mixture having an API gravity of at least about 19° at 15° C. and a viscosity at 40° C. of about 35 to about 60 cP, and preferably about 40 to about 50 cP.

In another embodiment a pipelineable mixture is provided which comprises a major amount of an oil having a viscosity at 40° C. in the range of about 60 to 250 cP and an API gravity at 15° C. in the range of about 15° to 17° and a diluent selected from the group consisting of naphtha and natural gas condensates in an amount sufficient whereby the mixture of oil and diluent has an API gravity at 15° C. of at least 19°.

DETAILED DESCRIPTION OF THE INVENTION

The heavy hydrocarbon material suitable for use in the practice of the present invention are those which contain a substantial position, i.e., greater than 50 vol. % of material boiling above 525° C., equivalent atmospheric boiling point. Indeed, of particular interest are the heavy hydrocarbon oils extracted from oil sands, most particularly Athabasca and Cold Lake oil sands. Typically, such heavy hydrocarbons at 40° C. have a viscosity exceeding 5,000 centipoise and an API gravity at 15° C. of less than about 10.5°.

According to this invention, the heavy hydrocarbon is first subjected to a hydroconversion process, i.e., the heavy hydrocarbon is contacted with hydrogen and a catalyst under pressure and temperature conditions sufficient to lower the viscosity of the hydrocarbon to the range of about 60 to about 250 cP at 40° C. Preferably the hydroconversion is conducted as a slurry at temperatures ranging between about 400° C. to about 450° C. and hydrogen partial pressures of about 700 psig to about 1500 psig.

Any hydroconversion catalyst may be used. Examples of a suitable catalyst employed in the hydroconversion are a molybdenum containing catalyst such as the phosphomolybdic acid catalyst disclosed in U.S. Pat. No. 5,620,591 and incorporated herein by reference or fly ash derived from bitumen coke. Typically, the catalyst is added to the heavy hydrocarbon in the range of about 100 ppm to about 7 wt. % based on the weight of heavy hydrocarbon. When the catalyst is a phosphomolybdic acid catalyst preferably it is added in the range of about 150 to about 500 ppm whereas when fly ash is used preferably it is used in the range of about 0.5 to about 5 wt. %.

After being converted under the foregoing conditions, the viscosity of the product oil is in the range of about 60 to 250 cP at 40°, the API gravity at 15° C. typically will be in the range of about 15° to 17°, which is not suitable for pipelining.

Next the API gravity of product oil is adjusted to 19° at 15° C. by adding sufficient diluent to the product oil. Typical diluents include naphtha and natural gas condensates. This also results in a blended product having a viscosity in the range of 35 to about 60 cP at 40° C. whereby the blended product is suitable for pipelining.

In an optional embodiment the catalyst used in the partial hydroconversion step may be removed from the product oil before adding diluent to adjust the oil API density.

As will be readily appreciated, adding diluent to a bitumen to render it pipelineable typically results in overtreatment from the standpoint of density. Conversely, subjecting a bitumen to hydroconversion to render it pipelineable results in over treatment from the standpoint of viscosity. The partial conversion and dilution process of the present invention provides a unique method for rendering a bitumen pipelineable while using significantly lower amounts of diluent than if only diluent were used while avoiding potential asphaltene phase separation that typically occurs if only hydroconversions were used.

EXAMPLES

Samples of a heavy hydrocarbon oil extracted from Cold Lake oil sands were subjected to partial hydroconversion at 420° C. for various residence times. The hydrocarbon oil had an initial viscosity at 25° C. of 30,700 cP. The catalyst used in the partial hydroconversion was a molybdenum containing catalyst. For each sample the equivalent residence time in seconds at 468° C. was determined. The viscosity and API gravity for the partially converted product also was determined. For each product the amount of diluent required to be added to meet a 19° API gravity was determined. Finally the viscosity of the blended product was determined. The results are given in the table below.

| Sample | Reaction Severity Equivalent Seconds @ 468°) | Viscosity (cP @ 25° C.) | Gravity (° API @ 15° C.) | Volume % Diluent Rcquired to Meet 19° API Gravity | Blended Viscosity (cP @ 40° C.) |
|---|---|---|---|---|---|
| A | 154 | 590 | 14.8 | 10.8 | 58 |
| B | 200 | 345 | 15.2 | 10.0 | 46 |
| C | 256 | 248 | 15.8 | 8.2 | 45 |
| D | 302 | 148 | 16.7 | 6.2 | 38 |
| Comp. | * | 30,700 | 10.2 | 21 | 113 |

*N/A = Not applicable

For comparative purposes, the amount of solvent required to be added to the oil not subjected to partial hydroconversion also is given in the table. As can be seen significantly more diluent is required for the Comparative Sample to meet the API gravity and even more diluent would be required to reduce the viscosity to at least 60 cP at 40° C.

What is claimed is:

1. A method for rendering a heavy hydrocarbon pipelineable using reduced amounts of diluent which comprises:

subjecting the hydrocarbon to hydroconversion under conditions and for a time sufficient to provide a product oil having a viscosity in the range of about 60to 250 cP at 40° C.; and, adding a diluent to the product oil in an amount sufficient to provide a mixture having an API gravity at 15° C. of at least about 19° and a viscosity of about 40 to about 50 cP at 40° C. whereby reduced amounts of diluent are used.

2. The method of claim 1 wherein the heavy hydrocarbon contains greater than about 50 vol. % of material boiling above 525° C., equivalent atmospheric boiling point.

3. The method of claim 2 wherein the hydroconversion is conducted as a slurry at temperatures ranging from between about 400° C. to about 450° C. and hydrogen partial pressure of about 700 to about 1500 psig.

4. The method of claim 2 wherein the hydroconversion is conducted in the presence of a catalyst selected from molybdenum containing catalyst and fly ash derived from bitumen coke.

5. The method of claim 4 wherein the diluent is a natural gas condensate.

6. In the method of preparing a heavy hydrocarbon for transportation through a pipeline by adding a diluent to the heavy hydrocarbon in sufficient amounts to provide a mixture having a viscosity at 40° C. in the range of about 35 to 60 cP, the improvement comprising:

first subjecting the heavy hydrocarbon to hydroconversion under conditions sufficient to provide a product oil without asphaltenes phase separation, the product oil having a viscosity at 40° C. in the range of 60 to 250 cP; and, adding a diluent in an amount sufficient to provide a mixture having an API gravity at 15° C. of 19° and a viscosity at 40° C. in the ranges of about 35 to about 60 cP whereby less diluent is added than in the absence of subjecting the hydrocarbon to said hydroconversion.

7. The improvement of claim 6 wherein the diluent is selected from the group consisting of naphtha and natural gas condesates.

8. The improvement of claim 7 wherein the heavy hydrocarbon is extracted from the oil sands.

* * * * *